US005381748A

United States Patent [19]

Lekhtman

[11] Patent Number: 5,381,748

[45] Date of Patent: Jan. 17, 1995

[54] WATER SPORT EQUIPMENT

[75] Inventor: David Lekhtman, Morin Heights, Canada

[73] Assignee: Windsaucer Corporation, Montreal, Canada

[21] Appl. No.: 130,654

[22] Filed: Oct. 1, 1993

[51] Int. Cl.[6] ..... B63B 35/79

[52] U.S. Cl. ..... 114/39.2; 114/103

[58] Field of Search ..... 114/39.2, 102, 103; 441/74, 75

[56] References Cited

U.S. PATENT DOCUMENTS 4,558,655 12/1985 DeBarge ..... 114/39.2

FOREIGN PATENT DOCUMENTS 2651478 3/1991 France ..... 114/39.2

*Primary Examiner*—Jesus D. Sotelo

*Attorney, Agent, or Firm*—Fishman, Dionne & Cantor

[57] ABSTRACT

The board member of the water sport equipment includes a steering arrangement and a control for controlling the steering arrangement. The glider member includes a stabilizer extending across a centerline of the glider member.

6 Claims, 3 Drawing Sheets

WATER SPORT EQUIPMENT

BACKGROUND OF INVENTION

1. Field of the Invention

The invention relates to water sport equipment. More specifically, the invention relates to such equipment which includes a board member, for carrying the user of the equipment, and a glider member, held by the user for catching the wind to propel the user. More specifically, the invention relates to such equipment wherein the board member includes a steering arrangement, and wherein the glider includes ribs and a stabilizer.

2. Description of Prior Art

Water sports equipment falling generally within the above description are taught in my U.S. Pat. No. 4,708,076, Nov. 24, 1987. However, the equipment of the '076 patent lacks some useful features which are incorporated in the inventive water sport equipment.

Thus, the board member of the '076 patent does not include a steering arrangement. In addition, it does not include any means for supporting the glider.

Again, the glider of the patented equipment is so constructed that, in an adverse wind, the sail of the glider could blow inward against the user. In addition, the glider of the patented equipment does not include a stabilizer which can aid in changing the attitude of the glider member regardless of the direction of the wind.

SUMMARY OF INVENTION

It is accordingly an object of the invention to provide water sports equipment which provide elements lacking in the prior art water sports equipment.

It is a more specific object of the invention to provide water sports equipment having a board member which includes a steering arrangement.

It is an even more specific object of the invention to provide such water sports equipment which includes control means for controlling the steering arrangement on the board member.

It is a still further object of the invention to provide water sports equipment whose board member includes means for supporting the glider member.

It is a still further object of the invention to provide water sports equipment having a glider member whose frame includes ribs.

It is an even further object of the invention to provide water sports equipment having a glider member with a stabilizer means.

In accordance with the invention there is provided water sport equipment to be employed by a user, and comprising:

a board member having a bottom surface and a top surface, said user being carried on said board member at the top surface thereof; and a glider member held by said user;

wherein, said board member comprises a steering arrangement, said steering arrangement comprising at least one pivoting rudder underlying the bottom surface of the board member, and control means, on the upper surface of said board member, for controlling the pivoting of said rudders;

whereby by controlling the pivoting of said rudders, said user is aided in steering said arrangement.

In accordance with the invention there is also provided water sport equipment to be employed by a user, comprising:

a board member for carrying said user;

a glider member to be held by said user;

wherein said glider member comprises a frame having a closed periphery, said frame having a sail mounted thereon, and at least one stabilizer means extending parallel to a centerline of said frame, said stabilizer means comprising a slat;

whereby, said user can control the attitude of said glider member using said stabilizer means.

BRIEF DESCRIPTION OF THE DRAWINGS

The invention will be better understood by an examination of the following description, together with the accompanying drawings, in which.

DESCRIPTION OF PREFERRED EMBODIMENTS

Figure 1A:
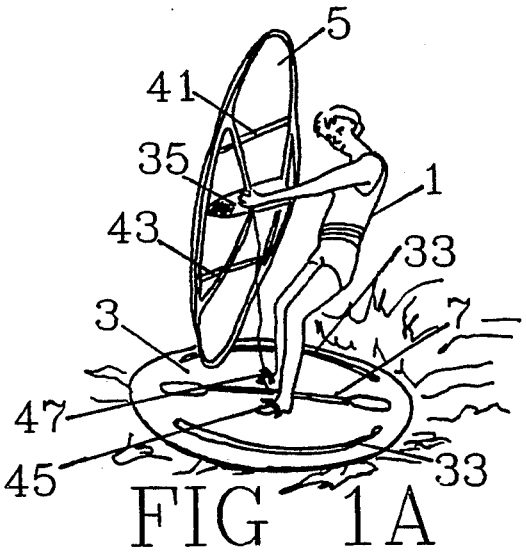
FIGS. 1A, 1B and 1C are perspective views of the equipment in use.
Figure 1B:
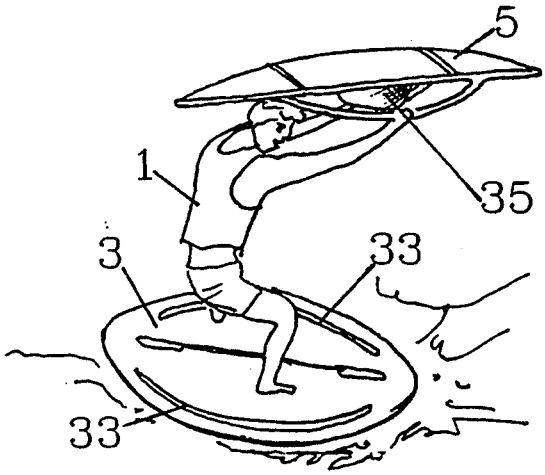
Figure 1C:
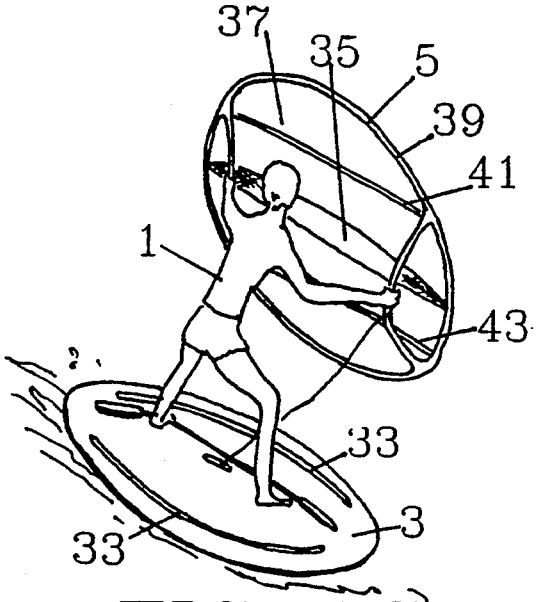
Figure 2A:
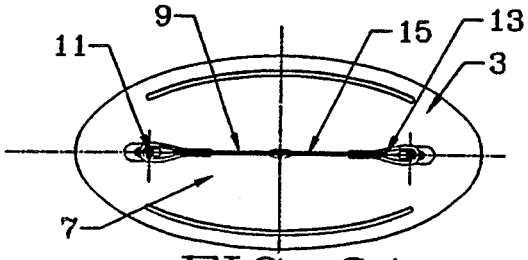
FIGS. 2A, 2B and 2C show the details of the board steering arrangement and the control means therefor.
Figure 2B:
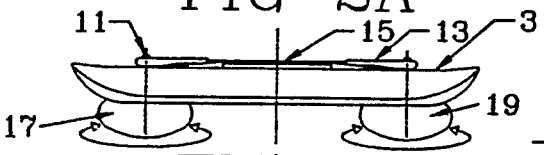
Figure 2C:
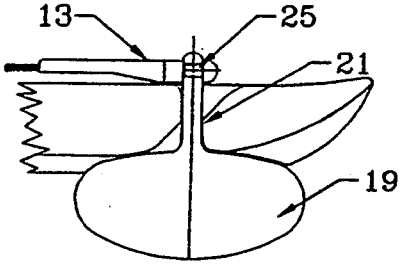

Referring to the drawings, and especially FIGS. 1A, 1B and 1C, a user 1 is standing on the top surface of a board member 3 and holding a glider member 5. The board member 3 includes a steering arrangement 7 which is better illustrated in FIGS. 2A, 2B and 2C. Referring to FIGS. 2A, 2B and 2C, the control means 9 of the steering arrangement comprises guide arms 11 and 13 connected by a connector, for example, a rubber band or spring 15.

Underlying the bottom surface of the board member are rudders 17 and 19. Preferably, the rudders are disposed at opposed ends of the board member. Each of the rudders is connected to a respective one of the guide arms. Thus, rudder 17 is connected to guide arm 11 and rudder 19 is connected to guide arm 13.

As seen in FIG. 2C, the top end of each rudder member (19 in FIG. 2C) comprises an axle 21 having an opening 23. Guide arm 13 includes a pin 25 which extends through the opening 23. Accordingly, when guide arm 13 pivots, rudder 19 will pivot with it. In a like manner, although not illustrated, when guide arm 11 pivots, rudder 17 will pivot with it.

Figure 3:
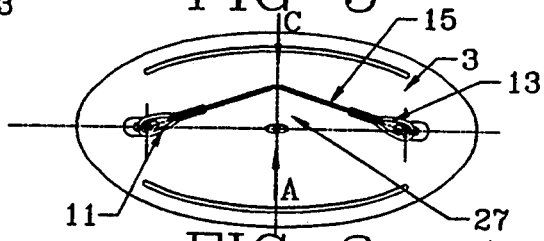
FIGS. 3 and 4 illustrate how the control means are operated.
Figure 4:
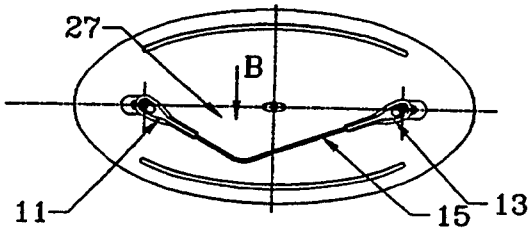
Figure 6:
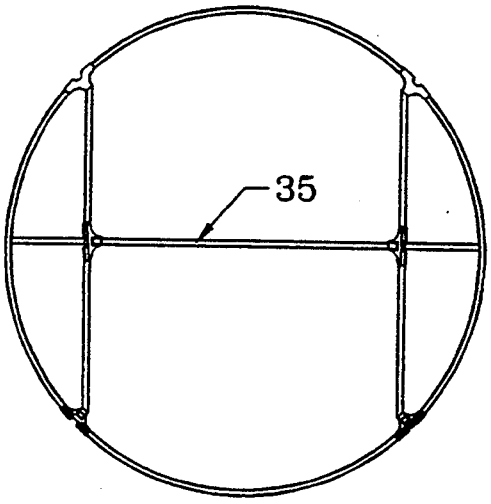
FIGS. 6, 7 and 8 illustrate in greater detail the stabilizer means of the glider member.
Figure 8:
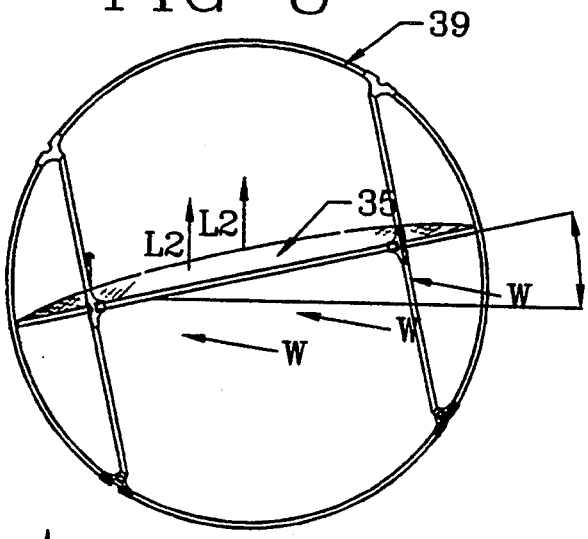
Figure 7:
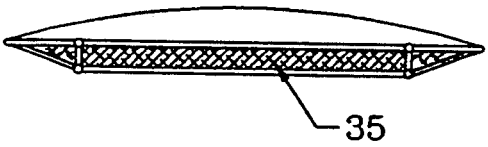
Figure 7:
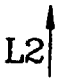

Referring now to FIGS. 3 and 4, to control the action of the rudders, the foot 27 of the user is placed up against the rubber band 15 and moved in, for example, the direction of the arrow A. Rudders 17 and 19 will pivot with the pivoting motion of guide arms 11 and 13. In FIG. 3, the tail end of the rudders will face inwardly and towards each other and the front end of the rudders will face outwardly and away from each other when controlled in the manner illustrated in FIG. 3.

It is not necessary that the foot 27 of the user be placed in the middle of the rubber connector 15. As shown in FIG. 4, the foot 27 of the rudder can be placed closer to the control arm 11 than to the control arm 13. Under this condition, rudder 17, which is associated with guide arm 11, will pivot more than rudder 19, which is associated with guide arm 13. This is, of course, because the guide arm 11 has pivoted more than the guide arm 13.

Obviously, the heel of the user's foot could be used to drive the rubber band 15 in the direction of arrow C of FIG. 3. This will, of course, provide a different type of steering than when the rubber band is moved in the direction of arrow A of FIG. 3.

Figure 5:
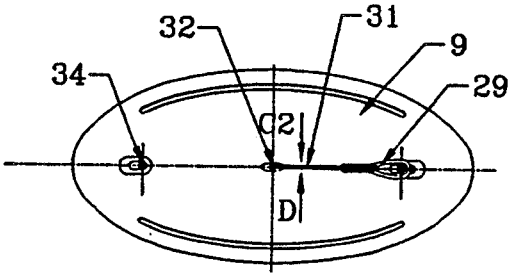
FIG. 5 illustrates a second embodiment of the control means.

Although FIGS. 1 to 4 have illustrated two guide arms with a connector, it is also possible, as illustrated in FIG. 5, to have only a single guide arm 29 connected to a single movable rudder (not shown). Connector 31, which is connected at one end to the guide arm, is connected at the other end to a fixed point 32. The connector 31 can be moved in the direction of either arrow C or D depending on whether the front or heel of the foot is used to move the rubber as illustrated with respect to FIGS. 3 and 4. A second fixed rudder can be disposed at 34, that is, diametrically opposite from the rudder associated with the guide arm 29. Alternatively, only a single pivotable rudder could be used.

A sail support means 33 runs parallel with the periphery of the board means as illustrated in FIGS. 1A, 1B and 1C. In the drawings, the support means is shown as following only a part of the periphery. Obviously, the support means can be a complete loop having the same shape but a different size than the periphery of the board. Although it is preferable that the support means be parallel to the periphery, it will be understood that the support means can follow other patterns as well.

The support means comprises either a groove or an upstanding ridge. To support the glider member, the bottom of the glider member is placed either against the ridge or in the groove as shown in FIG. 1A. When the glider member is rested on the board against the ridge or in the groove, if a wind attempts to blow the glider member away, the stopping action of the ridge or groove will prevent this.

The board member in accordance with the invention also includes cross straps 45 and 47 as shown in FIG. 1A. The cross straps will support the feet of the user when he assumes different positions standing on the board, and are preferably disposed centrally of the board member.

The glider member in accordance with the invention includes a stabilizer 35. As can be seen in FIGS. 1A, 1B and 1C and 6, 7 and 8, the stabilizer comprises a slat which extends at right angles to the sail 37 of the glider member and preferably extends parallel to or along the centerline of the frame 39 of the glider member. The stabilizer 35 can be used to help change the attitude of the glider member using the force of the wind or against the force of the wind. For example, in FIG. 8, with a wind blowing in the direction of arrows W, the glider member will be lifted in the direction of the arrows L. This is because the stabilizer is disposed at an angle to the horizontal. If the stabilizer were disposed at an angle−, then the same wind would force the glider member downwardly in a direction opposite to the direction of the arrows L.

Although only a single stabilizer has been shown, it will be obvious that two or more parallel stabilizers could be used.

The frame 39 of the glider member, in accordance with the invention, includes cross ribs 41 and 43. The cross ribs 41 and 43 are outwardly bowed, and the sail 37 is stretched over the cross ribs. Accordingly, the sail 37 cannot be blown inwardly as can the sail of the glider member in the '076 patent above referred to. Although only two ribs are illustrated in the drawings, it will of course be apparent that more than two ribs could be used.

In the drawings, the board member is illustrated generally as having an oval shape, and the glider member is illustrated as having a generally circular shape. It will be apparent to one skilled in the art that both the board member and the glider member could be circular, or both could be oval, or the glider member could be oval while the board member could be circular. In fact, the board member or glider member can be of any shape having a closed periphery.

Also, the method of steering the rudders and the stabilizer may be useful with other water or nonwater sporting equipment.

The operation of the sporting equipment will be apparent from the description of the functions above.

Although several embodiments have been described, this was for the purpose of illustrating, but not limiting, the invention. Various modifications, which will come readily to the mind of one skilled in the art, are within the scope of the invention as defined in the appended claims.

I claim:

1. Water sport equipment to be employed by a user, and comprising:

a board member having a bottom surface and a top surface, said user being carried on said board member at the top surface thereof; and a glider member held by said user;

wherein, said board member comprises a steering arrangement, said steering arrangement comprising at least one pivoting rudder underlying the bottom surface of the board member, and control means, on the upper surface of said board member, for controlling the pivoting of said rudders;

whereby by controlling the pivoting of said rudders, said user is aided in steering said arrangement;

wherein said control means comprises a guide arm fixedly connected to said rudder, and means for pivoting said guide arm;

whereby, said rudder pivots with said guide arm;

and wherein said board has a closed peripheral sail support means extending parallel to at least a portion of said periphery on said top surface thereof;

and wherein said support means comprises a groove.

2. Water sport equipment to be employed by a user, and comprising: member at the top surface thereof; and a board member having a bottom surface and a tip surface, said user being carried on said board member at the top surface thereof; and a glider member held by said user;

wherein, said board member comprises a steering arrangement, said steering arrangement comprising at least one pivoting rudder underlying the bottom surface of the board member, and control means, on the upper surface of said board member, for controlling the pivoting of said rudders;

whereby by controlling the pivoting of said rudders, said user is aided in steering said arrangement;

wherein said control means comprises a guide arm fixedly connected to said rudder, and means for pivoting said guide arm;

whereby, said rudder pivots with said guide arm;

and wherein said board has a closed periphery;

sail support means extending parallel to at least a portion of said periphery on said top surface thereof;

and further including two cross straps centrally disposed on the top surface of said board.

3. Water sport equipment to be employed by a user, and comprising:

a board member having a bottom surface and a top surface, said user being carried on said board member at the top surface thereof; and a glider member held by said user;

wherein, said board member comprises a steering arrangement, said steering arrangement comprising at least one pivoting rudder underlying the bottom surface of the board member, and control means, on the upper surface of said board member, for controlling the pivoting of said rudders;

whereby by controlling the pivoting of said rudders, said user is aided in steering said arrangement;

wherein said control means comprises a guide arm fixedly connected to said rudder, and means for pivoting said guide arm;

whereby, said rudder pivots with said guide arm;

and wherein said board has a closed periphery;

sail support means extending parallel to at least a portion of said periphery on said top surface thereof;

and further including two cross straps centrally disposed on the top surface of said board;

and wherein said steering arrangement comprises two rudders disposed at opposed ends of said board member, and two guide arms, a respective one of said guide arms being connected to a respective one of said rudders;

and connecting means connecting said guide arms.

4. Water sport equipment to be employed by a user, and comprising:

a board member having a bottom surface and a top surface, said user being carried on said board member at the top surface thereof; and a glider member held by said user;

wherein, said board member comprises a steering arrangement, said steering arrangement comprising at least one pivoting rudder underlying the bottom surface of the board member, and control means, on the upper surface of said board member, for controlling the pivoting of said rudders;

whereby by controlling the pivoting of said rudders, said used is aided in steering said arrangement;

wherein said control means comprises a guide arm fixedly connected to said rudder, and means for pivoting said guide arm;

whereby, said rudder pivots with said guide arm;

and wherein said board has a closed periphery;

said support means extending parallel to at least a portion of said periphery on said top surface thereof;

and further including two cross straps centrally disposed on the top surface of said board;

and wherein said steering arrangement comprises two rudders disposed at opposed ends of said board member, and two guide arms, a respective one of said guide arms being connected to a respective one of said rudders;

and connecting means connecting said guide arms;

and wherein said connecting means comprises a rubber band or spring.

5. Water sport equipment to be employed by a user, comprising:

a board member for carrying said user;

a glider member to be held by said user;

wherein said glider member comprises a frame having a closed periphery, said frame having a sail mounted thereon, and at least one stabilizer means extending parallel to a centerline of said frame, said stabilizer means comprising a slat;

whereby, said user can control the attitude of said glider member using said stabilizer means.

6. Equipment as defined in claim 5 wherein said frame includes at least two outwardly bowed ribs, said sail being stretched across said ribs.

* * * * *